United States Patent [19]

Jarosz et al.

[11] Patent Number: 4,481,495

[45] Date of Patent: Nov. 6, 1984

[54] FUSIBLE ELEMENT FOR A CURRENT-LIMITING FUSE HAVING GROUPS OF SPACED HOLES OR NOTCHES THEREIN

[75] Inventors: John M. Jarosz, Skokie; William R. Panas, Glenview, both of Ill.

[73] Assignee: S&C Electric Company, Chicago, Ill.

[21] Appl. No.: 437,776

[22] Filed: Oct. 29, 1982

[51] Int. Cl.[3] ..... H01H 85/04

[52] U.S. Cl. ..... 337/159; 337/290; 337/292

[58] Field of Search ..... 337/159, 161, 290, 292, 337/295, 297, 158

[56] References Cited

U.S. PATENT DOCUMENTS

| | | | |
|---|---|---|---|
| 2,883,891 | 5/1958 | Jacobs | 337/158 X |
| 4,041,435 | 8/1977 | Gaia | 337/161 |
| 4,123,738 | 10/1978 | Huber | 337/159 |

FOREIGN PATENT DOCUMENTS

| | | | |
|---|---|---|---|
| 738344 | 10/1955 | United Kingdom | 337/293 |

*Primary Examiner*—George Harris

*Attorney, Agent, or Firm*—Kirkland & Ellis

[57] ABSTRACT

A fusible element for a current-limiting fuse comprises a metal ribbon having groups of holes therethrough and therealong. The distance along the ribbon between adjacent holes in a group is less than the distance along between adjacent groups. The lateral width of the ribbon between the hole groups is greater than its laterial width where the holes are located. The ribbon initially melts at the holes and multiple arcs burn back the ribbon at a first rate until the ribbon containing the holes is consumed, following which merger of the arcs occurs. This merger and the greater width of the ribbon between the groups results in burn-back of the ribbon at a second reduced rate. In this way, both 9 kv and 15 kv fault currents may be interrupted without exceeding the spark-over voltage of phase-to-ground arrestors when 9 kv fault currents are interrupted.

18 Claims, 10 Drawing Figures

10
18
14
34
22
20
28
12
26
24
22
20
30
28
16
34
32

12
40
42
44
46
48
50
52
54
56
60
62
64
66
68
46,54

FUSIBLE ELEMENT FOR A CURRENT-LIMITING FUSE HAVING GROUPS OF SPACED HOLES OR NOTCHES THEREIN

BACKGROUND OF THE INVENTION

1. Field of the Invention

The present invention relates to an improved fusible element for a current-limiting fuse and, more particularly, to an improved fusible element for a current-limiting fuse capable of protecting a high-voltage circuit against faults, which faults may occur at either a higher phase-to-phase voltage or a lower phase-to-ground voltage. More specifically, the present invention relates to an improved fusible element for a high-voltage current-limiting fuse capable of effectively interrupting faults at either voltage, which fusible element will not generate more than a predetermined back voltage while interrupting faults at the lower voltage. The present invention is an improvement of the invention described and claimed in commonly assigned U.S. Application, Ser. No. 194,712, filed Oct. 6, 1980, now Pat. No. 4,359,708, in the name of the inventors hereof.

Current-limiting fuses are, in general, well known. Such fuses serve two functions. First, and in common with all fuses, a current-limiting fuse responds to fault currents or other over-currents in a circuit by interrupting the current to protect the circuit. Such response is brought about by the inclusion in the fuse of a fusible element made of a material which melts, fuses, vaporizes or otherwise becomes disintegral when the $I^2t$ heating effect of the fault current therein exceeds some predetermined value, determined by the dimensions and material of the fusible element. Second, unlike other types of fuses—power fuses and cutouts, for example—current-limiting fuses limit the magnitude of the fault current to some maximum value while interrupting it.

The most common type of current-limiting fuse is the so-called silversand fuse. In such a fuse, the fusible element is intimately surrounded by a compacted fulgurite-forming medium, such as silica or quartz sand. A fulgurite is a silicon substance formed by the fusing or vitrification of the sand or other medium due to its absorption of high energy, such as that accompanying lightning or an electric arc. The fusible element is often a ribbon of a fusible metal, such as elemental silver or copper, which may be straight or curvilinearly wound (for example, in a helical or spiral configuration) within an insulative housing for the sand. The ribbon may contain a pluarality of holes or notches formed therethrough or therein which, in effect, decrease the cross-section of the ribbon at selected points. See U.S. Pat. Nos. 4,123,738, 4,204,183, 4,204,184, and 4,210,892; Canadian Patent No. 876,884 (July 27, 1971); and West German Auslegeschrift No. 1,193,154 (May 20, 1965).

For purposes of explaining the present invention, it is assumed that a current-limiting fuse of the prior art is connected in a circuit between an AC power source and a load powered by the source, the fusible element being in electrical series with the source and the load. The circuit may be one phase of an AC high-voltage, three-phase electrical system, each phase of which may include a similar fuse. The circuit may be viewed as also containing a single series inductance representative of all the inductance thereof "lumped" together.

The fusible element of each fuse is selected so that if the current driven through the circuit to its load by the source is "normal," that is, below a selected level, the heating effect of the current ($I^2t$) is insufficient to melt, fuse or vaporize the fusible element at any of the holes or notches where its cross-section is decreased. During the time normal current flows, there is a small, nearly zero, voltage drop across each fuse. If, for any reason, the current in any fuse exceeds the selected level for a sufficient time (e.g., due to an overload or fault), $I^2t$ is sufficient to melt, fuse or vaporize its fusible element across the width thereof at the points of formation of the holes or notches.

At each melted location—which quickly assumes a pair of sites or fronts extending across the width of the fusible element, the sites being separated along the length of the ribbon—a gap is produced. An arc is established in each gap with its ends terminating on the separated sites or fronts. Each arc generates an arc voltage or back voltage opposite in polarity to the source voltage, the total arc voltage of the fuse being the cumulative or additive effect of the arc voltages of all the arcs so formed. Thus, if the fusible element has one hole or notch therein, an initial arc or back voltage $V_a$ is generated; if the fusible element has four similar holes or notches therein, an initial arc or back voltage 4 $V_a$ is generated; if the fusible element has N similar holes or notches, an initial arc or back voltage $NV_a$ is generated. Typically, the initial arc or back voltage of the fuse "jumps" or rises in a very short time from the small, nearly zero, normal voltage drop across the fuse to a substantial value which is initially somewhat less than the source voltage. This jump or rise in the fuse's arc voltage or back voltage occurs immediately after the arc or arcs form.

Each arc is both constricted and cooled by the compacted sand; both effects further elevate the arc or back voltage of the fuse. Constriction is the result of "forcing" each arc to traverse a path confined by the compacted grains of the sand which reside in and about each gap between the sites or fronts. Cooling of the arcs, which is due to "heat-sink" effect of the sand, absorbs energy therefrom, thereby forming the fulgurite.

Following their initial formation, the arcs "burn back" or melt away the element in opposite directions away from the former location of the holes or notches. The ends of each arc, and the respective opposed sites or fronts on which each terminates, constantly "move" away or recede from each other as each arc burns back the element to widen the gap in which it is formed. The "movement" of the sites or fronts away from each other elongates the arcs and exposes the ends of each arc to "fresh" or "new" sand. The "fresh" or "new" sand further constricts and further cools the elongating arcs. Thus, as long as the arcs persist and ribbon is available for consumption by the arcs, they continually elongate and have their elongating length further constricted and cooled. This results in yet further elevation of the arc or back voltage with time. Ultimately, the arc or back voltage of the fuse exceeds the source voltage. In sum, then, the arc or back voltage generated by the fuse depends on both the number of arcs formed and the amount of burn-back of the element by these arcs. The rate of burn-back is, in turn, related to the material and shape of the fusible element and to the level of current in the fusible element.

Shortly after the initial jump in arc or back voltage, which is followed by a continuing increase therein with time due to burn-back, the circuit current (which is out of phase with the circuit voltage due to the circuit inductance) begins to "turn down" or to be forced to continuously decreasing levels. As the current turns down, the arc voltage continues to increase, albeit at a slower rate, as the arcs continue to burn back the fusible element. The increasing arc voltage causes the current to continuously turn down or decrease. Assuming there to have been a sufficiently long fusible element with sufficient distance between the holes or notces, this process continues until the current is "turned down" to zero. At zero current in the fuse, the circuit is interrupted if the dielectric strength of the gaps is sufficiently high. The turn down is current shortly after the arc or back voltage begins to increase results in the fuse acting in a current-limiting or energy-limiting manner. That is, during the operation of the fuse, the circuit current assumes a lower maximum value—its value just prior to turn-down—than it otherwise would have assumed, thus protecting the circuit and devices connected thereto from excessive over-currents.

During the operation of a silver-sand current-limiting fuse, arc or back voltages in excess of the source voltage are generated. Indeed, it is necessary that the fuse's arc or back voltage exceed the source voltage for current limitation to occur. If the fusible element is very long, current interruption may be very effective, although very high arc or back voltages will be generated. As a result, typical current-limiting fuses include elements of reasonable lengths, that is, lengths selected so that the elements are nearly totally burned back or nearly consumed at a time when the turn-down in current is sufficient to assure that current zero will be reached. Should the fusible element be totally consumed, all the arcs merge into a single long arc, the arc or back voltage of which cannot further increase because no "fresh" or "new" sand can be introduced into the gaps. In typical fusible elements, the holes or notches are evenly spaced so that the fusible element is burned back the same amount between each hole or notch, and so that merger of all arcs into the single long arc takes place at the same time. Before merger, the number of arcs is equal to the number of holes or notches and the number of receding sites or fronts at which burn-back occurs is twice the number of holes. Thus, while typical current-limiting fuses operate prior to merger, the arc or back voltage thereof is simply equal to the product of the number of holes or notches initially present multiplied by the arc or back voltage of any one of the similar arcs. The arc or back voltage of the fuse increases as long as burn-back occurs and the rate of the arc or back voltage increase is equal to the product of the number of holes or notches multiplied by the rate of arc or back voltage increase of any one of the similar arcs.

In many circuits, faults may occur at a lower or a higher voltage. In a 15 kv (phase-to-phase voltage) three-phase AC circuit, for example, phase-to-phase fault currents are, in effect, driven by a 15 kv source voltage while phase-to-ground fault currents are driven by a phase-to-ground source of approximately 9 kv. If current interruption is the sole desideratum, a single fusible element can be chosen which will ensure interruption of fault currents at both voltages. Specifically, a fusible element sufficiently long to generate a very high arc or back voltage at either source voltage can be selected.

Thus, the fuse in each phase can be selected so that it is, by itself, capable of interrupting phase-to-ground fault currents which occur only in its phase and which are not "seen" by the other phases or the fuses therein. Care must be used, however, in selecting fusible elements which will not cause the operation of surge arrestors connected between each phase and ground. If the selected fusible element is "too long" or for any other reason generates an arc or back voltage which is "too high," the arc or back voltage of the fuse will ultimately exceed the surge arrestor voltage and cause sparkover thereof. Arrestors rated 9 kv (phase-to-ground voltage) will typically sparkover at about 25–27 kv. Thus, when the fuse interrupts phase-to-ground fault currents driven by a 9 kv source voltage, it is desirable that the arc or back voltage of the fuse not exceed 25–27 kv.

Even though each fuse by itself might not be capable of interrupting fault currents driven by the higher (15 kv) phase-to-phase voltage, such faults necessarily involve the fuses of the faulted phases in electrical series. Accordingly, the fuses are selected so as to be able, in a series combination, to interrupt the fault current by together generating a sufficiently high arc or back voltage.

From what has been said above, in typical current-limiting fuses the fusible element itself is the current-responsive "trigger" for the fuse. When current gets sufficiently high, the $I^2t$ effect thereof initiates melting of the fusible element followed by current-interrupting operation of the fuse. This is true even in a phase-to-phase fault current situation where a fuse in one involved phase may operate before a fuse in another involved phase, due, for example, to normal manufacturing tolerances. Specifically, although one fuse may operate first and generate an arc or back voltage preventing the fault current from further increasing, the second fuse will, nevertheless, eventually operate because the element thereof responds to $I^2t$, not to I. That is, although $I^2$ may not increase, the product of $I^2$ and t will initiate operation of the second fuse when it becomes sufficiently large.

In a variant type of current-limiting fuse, a silver-sand fuse is shunted by a normally closed, high current-capacity switch. See commonly assigned U.S. Pat. No. 4,342,978, issued Aug. 3, 1982 in the name of Otto Meister; and commonly assigned U.S. patent applications, Ser. No. 188,660, filed Sept. 19, 1980, now U.S. Pat. No. 4,370,531, in the name of Thomas Tobin; Ser. No. 179,367, filed Aug. 18, 1980 (now abandoned in favor of continuation application Ser. No. 550,201, filed Nov. 9, 1983) in the names of John Jarosz and William Panas; and Ser. No. 179,366, filed Aug. 18, 1980 (now abandoned in favor of continuation application Ser. No. 539,396, filed Oct. 6, 1983) in the name of Raymond O'Leary. Because the switch has a high current-carrying ability, this arrangement permits the combination to have a very high continuous-current-carrying ability, which silver-sand fuses used alone do not have. The switch is opened by a current-sensor when the current reaches a value in excess of a selected level. The sensor responds to I or dI/dt, not to $I^2t$. When the switch opens, the current is entirely commutated to its fuse which begins to operate. As the fuse begins to operate, the fault current begins to decrease, as described above, whether the fault current is phase-to-phase or phase-to-ground. If, due to tolerance differences between the sensors associated with the fuses in two phases between which a fault current flows, only one sensor initially responds, the second sensor will not later respond because the fault current level is decreasing. Thus, only one fuse may be available to interrupt phase-to-phase fault currents, and its fusible element must be selected to achieve this end. Accordingly, each fuse must be capable of itself interrupting fault currents at the higher phase-to-phase voltage, assumed above to be 15 kv. As noted above, this can easily be achieved by appropriate selection of a fusible element. A problem arises, however, at lower voltage phase-to-ground fault currents where too long an element—that is, an element sufficiently long to interrupt phase-to-phase fault currents—is present.

Specifically, phase-to-ground fault currents commutated to the fuse by the opening of the switch cause the fusible element to melt at the holes or notches, as do the higher voltage phase-to-ground fault currents, and initiate burn-back of the fusible element at each site or front pair of either end of each arc. This action, as described above, effects the generation of the arc or back voltage. It has been found, however, that the arc voltage generated by a silver-sand current-limiting fuse, which by itself is capable of interrupting phase-to-phase fault currents, may well exceed the spark-over voltage of the phase-to-ground surge arrestors while interrupting phase-to-ground fault currents. Spark-over of the surge arrestors under the conditions described is undesirable, for arrestors are intended to protect the circuit in the event of surges such as those caused by lightning, and not by surges caused by current interruption by the fuse.

Commonly assigned U.S. patent application, Ser. No. 194,712, filed Oct. 6, 1980 now U.S. Pat. No. 4,359,708 discloses and claims a fusible element for a current-limiting fuse which interrupts fault currents driven by both higher phase-to-phase voltages and lower phase-to-ground voltages, while limiting the arc voltage generated by the fuse during interruption of fault currents at the lower voltage. Specifically, the fusible element comprises a conductive ribbon. A number of groups of holes or notches are formed through or in the ribbon. The groups extend single-file along the ribbon. Adjacent holes or notches of each group are spaced apart along the ribbon by a small distance. Adjacent groups are spaced apart along the ribbon by a distance substantially greater than the distance between the adjacent holes or notches within each group.

Faults occuring at higher phase-to-phase voltages melt the ribbon first at the reduced cross-sectional points thereof—that is, those locations where the holes or notches have been formed—and then burn back the ribbon between the groups until current interruption is effected. Lower phase-to-ground voltage fault currents first melt the ribbon at the hole locations, just as do the higher voltage fault currents. Because the distance between the holes within the groups is small, the numerous arcs formed first burn back the ribbon along the shorter distance between the holes and then the arcs of each group merge into a single arc. The ribbon is thereafter burned back between the groups by the merged arcs at a more gradual total rate than occurred before the merger because of the absence of holes therein and because the merger decreased the total number of arcs. The fusible element is, accordingly, provided with the opportunity to interrupt lower phase-to-ground fault currents by generating a more slowly increasing, lower back voltage (rather than one that is "too high"), thus preventing the back voltage of the fuse from exceeding a selected value, such as the sparkover value of the surge arrestors.

It has been found that, in some circumstances, the more gradual burn-back rate which occurs after group arc merger may still increase "too quickly" and may generate too high a back voltage when interrupting phase-to-ground fault currents. That is, the burn-back rate of the ribbon between the hole groups by the merged arcs may be too fast, thereby generating sufficient back voltage to cause sparkover of surge arrestors. Accordingly, a general object of the present invention is to provide an improved fusible element of the type set forth in U.S. Pat. No. 4,359,708 which effectively interrupts fault currents driven by both higher phase-to-phase voltages and lower phase-to-ground voltages, while limiting, with more assurance, the back voltage generated by the fuse during interruption of fault currents at the lower phase-to-ground voltage.

SUMMARY OF THE INVENTION

With the above and other objects in view, the present invention contemplates an improved fusible element for a current-limiting fuse. The fusible element comprises a thin, elongated conductive ribbon of substantially uniform thickness over its length. The ribbon has first and second regions of two different widths which alternate along the ribbon. The first regions have a width greater than the width of longitudinally adjacent second regions. There are at least two second regions.

A plurality of groups of holes or notches are formed through or in the ribbon within and along the narrower second regions along the ribbon. Adjacent holes or notches of each group are separated within the group along the ribbon by a first distance. This first distance is substantially less than a second distance, also measured along the ribbon, between adjacent groups of holes.

Faults occurring at higher phase-to-phase voltages first melt the ribbon at the reduced cross-sectional points thereof—that is, at the second narrower regions where the holes or notches have been formed—and then burn back the ribbon between the groups—at the wider first regions—until current interruption is effected. Lower phase-to-ground voltage fault currents first melt the ribbon at the second regions, just as do the higher voltage fault currents. Because the distance between the holes within the groups at the second regions is small, the numerous arcs first burn back the ribbon along the shorter distance between the holes and then the arcs of each group merge into a single arc. The ribbon is thereafter burned back at the first regions between the groups at a more gradual rate for two reasons. First, as in U.S. Pat. No. 4,359,708 the rate is more gradual due to arc merger. Second, (and absent from U.S. Pat. No. 4,359,708), the rate is further slowed by the greater width of ribbon at the first regions. This greater width requires that a greater amount of material be consumed by the merged arcs and decreases the current density in the ribbon. Both arc merger and the wider second regions prevent the back voltage of the fuse from exceeding a selected value, such as the sparkover value of phase-to-ground arrestors, when a phase-to-ground fault current is interrupted.

In an alternative embodiment, the ribbon has an appearance similar to two or more of the above-described ribbons attached to each other or unitarily formed side-by-side with laterally adjacent first regions being integral. Laterally adjacent second regions are separated, as by elongated slits formed periodically through or in and along the ribbon. A group a holes or notches is formed through or in the ribbon in each second region. As before, the distance between longitudinally adjacent holes in each group is substantially less than the distance between longitudinally adjacent groups of holes. This structure, in effect, yields a pair of side-by-side fusible elements which are usable where a current-limiting fuse requires two ribbons, for example, to lower the fault current density therein. Laterally adjacent second regions may be oppositely deformed or offset above and below the surface of the ribbon. In this way, when the ribbon is located in a fulgurite-forming medium, typically by being helically wound on a support, the offset side-by-side second regions are sufficiently far apart to ensure that the individual or merged arcs are each in "fresh" sand capable of efficiently performing its energy-absorbing function. The offset also ensures that the arcs or merged arcs in one group do not merge or interact with those of a laterally adjacent group until arcing reaches the first regions.

BRIEF DESCRIPTION OF THE DRAWING

FIGS. 3(*a*)–3(*c*) depict the fusible element of FIG. 2 at various times after the inception of a fault current therein at both low and high voltages;

FIGS. 6(*a*)–6(*c*) depict the fusible element of FIGS. 4 and 5 at various times after the inception of a fault current therein at both low and high voltages.

DETAILED DESCRIPTION

Figure 1:
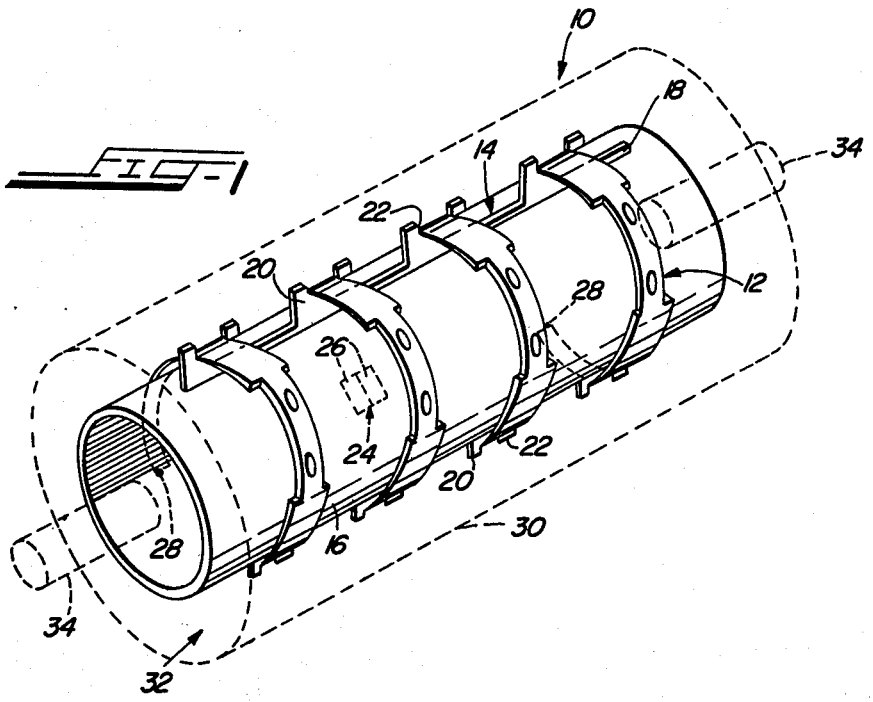
FIG. 1 is a generalized, perspective view of a portion of a current-limiting fuse which includes a fusible element according to the principles of the present invention.
Figures 2, 3A, 3B, 3C:
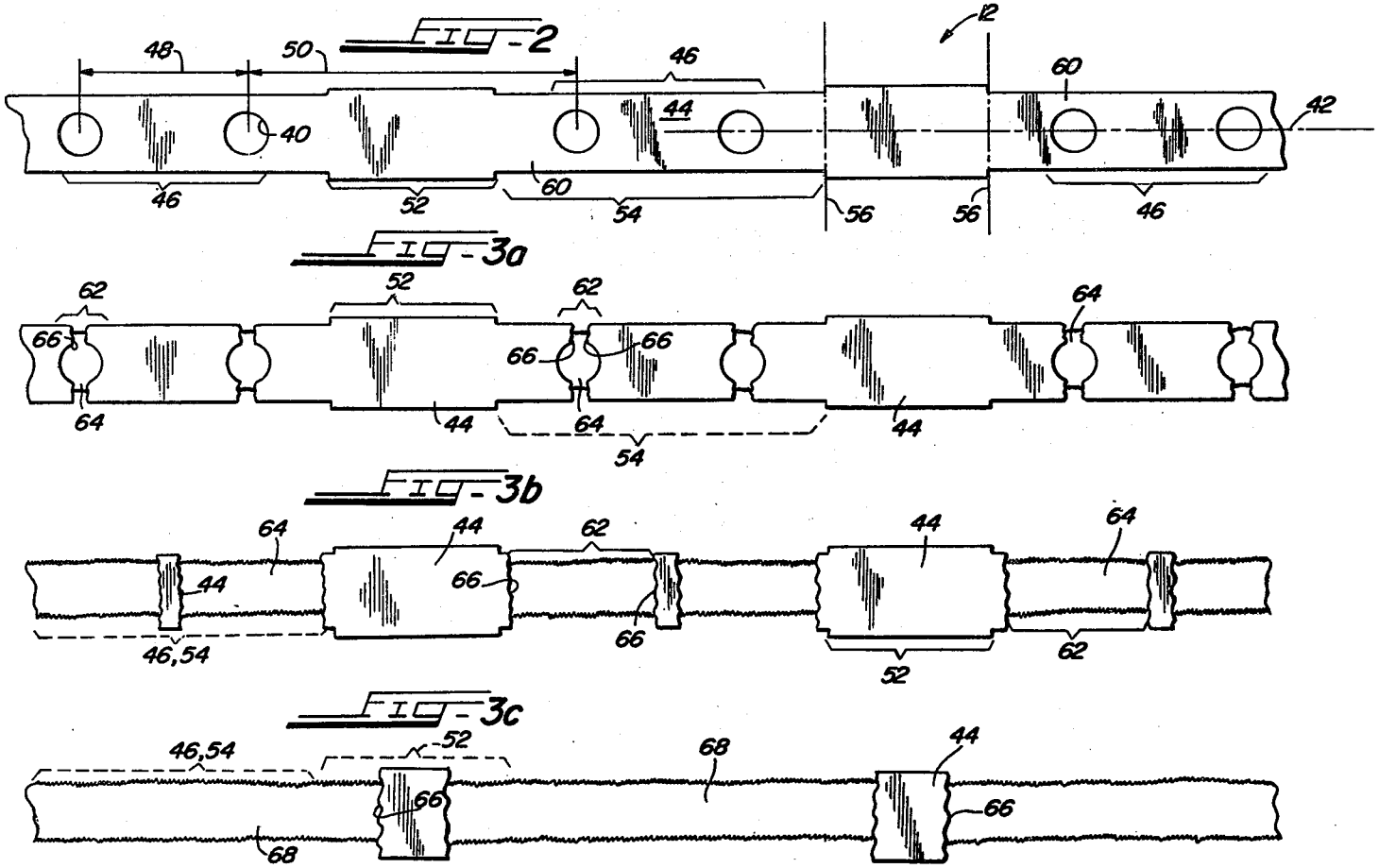
FIG. 2 is a plan view of a first embodiment of the fusible element according to the present invention, which element is usable in the current-limiting fuse of FIG. 1.
Figures 4, 5, 6A, 6B, 6C:
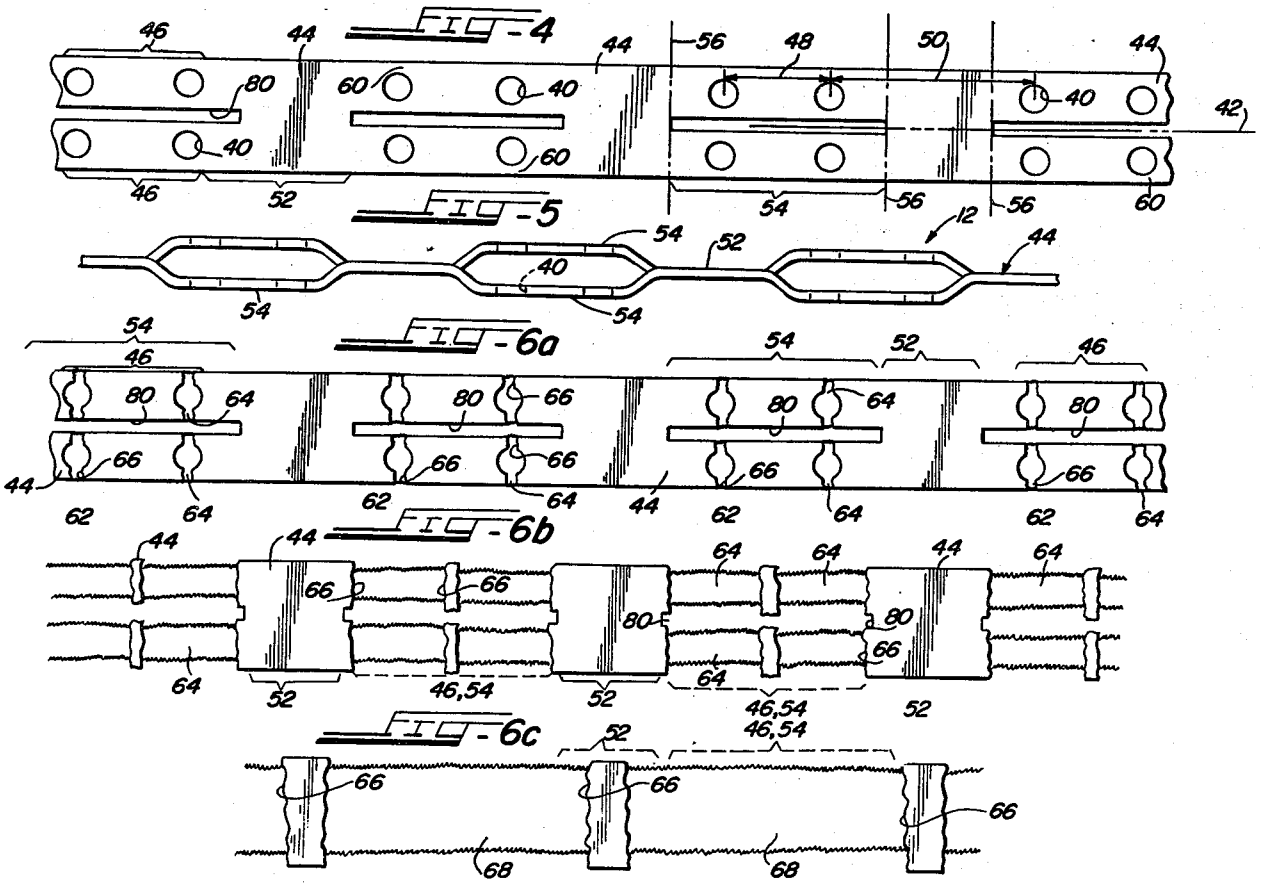
FIG. 4 is a plan view of an alternative embodiment of the fusible element according to the present invention.
FIG. 5 is a generalized side elevation of the fusible element shown in FIG. 4.

Referring first to FIG. 1, there is shown a current-limiting fuse 10 which includes a fusible element 12, as depicted in FIG. 2 or 4 according to the present invention. Various portions of the fuse 10 are shown only generally, and some portions thereof are shown only in phantom for the sake of clarity.

The fuse 10 includes the fusible element 12 held in a circular, helical configuration by an element support 14, which may be of the type more fully described in commonly assigned U.S. Application, Ser. No. 181,603, filed Aug. 27, 1980 in the names of John Jarosz and William Panas. The support 14 may include a hollow, cylindrical, insulative cylinder 16 to which are attached in diametric opposition a pair of fins 18. The fins 18 include a series of projections 20 and are attached to the cylinder 16 so that the projections are offset therealong. The projections 20 include trapezoidal notches 22 into which the fusible element is wound and snapped and which hold the element 12 in the circular, helical configuration depicted. As described below, the fusible element 12 has a varying cross-section at selected locations, which variations are not depicted in FIG. 1.

The cylinder 16 may house a normally closed switch, only a portion of which is schematically shown at 24, which may include a pair of contacts 26 movable apart along a fixed line of direction within the cylinder 16. The ends 28 of the fusible element 12 are electrically connected in shunt with the contacts 26 by facilities (not shown). Current normally flows through the switch 24 which shunts all or a majority thereof away from the fusible element 12. When the switch 24 opens and its contacts 26 move apart, current is commutated to the fusible element 12 for interruption thereof.

Surrounding the fusible element 12 and the cylinder 16 is an outer housing 30 made of an insulative material, such as cycloaliphatic or bisphenol epoxy resin. The housing 30 and the cylinder 16 define a volume 32 therebetween which may be filled with fulgurite-forming medium (not shown) such as silica sand or quartz sand. As is well known, the fusible element 12 and the medium co-act to interrupt current in the element 12 in a current-limiting or energy-limiting manner. The entire fuse 10 is mountable and electrically connectable into an electrical circuit (not shown) by end terminals 34 which may protrude beyond the ends of the cylinder 16 and the housing 30. The terminals 34 are continuously electrically connected to both the respective ends 28 of the fusible element 12 and the respective contacts 26 in any convenient manner.

Turning now to FIG. 2, a first embodiment of the fusible element 12 is depicted. A longitudinally extending series of holes 40 is formed through the fusible element 12. The holes 40 are depicted as being circular and as being centrally located on a major axis 42 of the fusible element 12 along the length thereof. It is to be understood that the holes 40 may have other shapes and need not be centered on the axis 42 of the element 12. Further, the holes 40 may be replaced by notches, that is, regions of any shape formed through the element 12 at the edges thereof. Also, the holes or notches 40 need not extend completely through the element 12, but need only effectively reduce its cross-sectional area at their points of formation.

In preferred embodiments, the element 12 is a thin copper ribbon 44, although other metals, such as elemental silver, may be used. The element 12 illustrated is intended for use in 15 kv circuits in which faults at either 15 kv (phase-to-phase faults) or at 9 kv (phase-to-ground) may occur. Accordingly, the element 12 may be approximately 46-¼ inches long and 0.008 inches thick. At other voltages, or when other materials are used, the element 12 may have a different length or a different thickness, as should be apparent.

Also, as depicted in FIG. 2, the element 12 is shown in a flat, straight configuration. As described with reference to FIG. 1, it is understood that the element 12 is preferably intended to be used in the helical, circular configuration, although other configurations are possible. Lastly, it is intended that the element 12 be intimately surrounded by a fulgurite-forming medium, as noted earlier.

The holes 40 are located in serial groups 46, there being two holes 40 in each group 46, and there are at least two groups 46. The two holes 40 of each grup 46 are longitudinally separated by a center-to-center distance 48 which is substantially shorter than the center-to-center, longitudinal distance 50 separating adjacent groups 46. In the specific example of FIG. 2, the distance 48 may be about 0.470 inch, while the distance 50 may be about 0.937 inch. Where the continuous current rating of the fuse 10 is 200 amperes, each hole 40 may have a diameter of about 0.131 inch, so that the edge-to-edge spacing between longitudinally adjacent holes 40 in each group 46 may be about 0.339 inch and the edge-to-edge spacing between the facing end holes 40 of longitudinally adjacent groups 46 may be about 0.806 inch. If the fuse 10 has a continuous current rating of 600 amperes, each hole 40 may have a diameter of about 0.165 inch, so that the edge-to-edge spacing between longitudinally adjacent holes 40 in each group 46 may be about 0.305 inch and the edge-to-edge spacing between the facing end holes 40 of longitudinally adjacent groups 46 may be about 0.772 inch.

The ribbon 44 also includes alternating first and second regions 52 and 54 along its length. There are at least two second regions 54. Each second region 54 contains one group 46 of holes 40, while the first regions 52 contain no holes. The regions 52 are wider, transversely of the axis 42, than the regions 54, so that the edges of the ribbon 44 may assume an undulating configuration. In FIG. 2, the regions 52 may have a length of about 0.467 inch between "ends" 56 thereof measured along the axis 42, while the regions 54 may have a length of about 0.940 inch between the "ends" 56. Where the ribbon 44 is used in a fuse 10 having a 200 ampere continuous current rating, the regions 54 may be about 0.263 inch wide (transverse to the axis 42) and the distance between the longitudinal "end" 56 of each region 54 and the edge of the facing end holes 40 of each adjacent group 46 may be about 0.1695 inch. If the ribbon 44 is used in a fuse 10 having a 600 ampere continuous current rating, the regions 54 may be about 0.357 inch wide and the distance between the longitudinal "end" 56 of each region 54 and the edge of the facing end holes 40 of each adjacent group 46 may be about 0.1525 inch. Preferably, the distance between each "end" 56 and the facing end hole 40 of an adjacent group 46 is about one-half of the distance between adjacent holes 40 in each group 46.

As shown in FIG. 2, the regions 52 and 54 are preferably alternating rectangles, centered on the axis 42 with the holes 40 centered between the edges of the second regions 54. With this construction, which is easily formed by stamping, the ribbon 44 and the holes 40 are symmetrical about the axis 42, and the undulating edges of the ribbon 44 have a square-wave configuration. The locations of the holes 40 and of the regions 52 and 54 need not be symmetrical about the axis 42 (though such symmetry is preferred). If the holes 40 are not on the axis 42, it is preferred that they all be the same distance to one side or the other of the axis 42. If the regions 52 and 54 are not laterally symmetrical relative to the axis 42 (though such symmetry is preferred), it is preferred that they be similarly asymmetrical relative thereto. The undulating edges of the ribbon 44 need not have a square-wave configuration (though, again, this configuration is preferred) and may assume other undulating configurations such as sinuous, triangular, etc. Regardless of the configuration of the edges, it is important that the groups 48 of holes 40 be formed in the narrower second regions 54, with the wider, non-hole first regions 52 being therebetween.

It is not necessary that each group 46 have only two holes 40. As in the '712 application, each group 46 may contain two or more holes 40. The spacings between the holes 40 and between the groups 46, as well as the dimensions of the regions 52 and 54, may be varied depending on the number of holes 40 in each group, in accordance with the principles of the '712 application. Further, the length of the ribbon 44 and the widths of the regions 52 and 54 may be varied in accordance with the material of the ribbon 44, the voltage and current at which the fuse 10 is used, and the voltage at which fault currents may be driven.

Turning now to FIGS. 3(*a*)–3(*c*), a portion of the ribbon 44 in FIG. 2 is depicted at various times during operation of the fuse 10 in which it is included. Upon the occurrence of a fault current, the switch 24 opens and portions of the ribbon 44 laterally adjacent to the holes 40 in the regions 54, generally shown at 60 in FIG. 2, immediately melt or evaporate to form gaps 62, FIG. 3(*a*). One or more arcs 64 form in each gap 62 between opposed sites or fronts 66 defining the gaps 62. Each arc 64 develops an arc voltage or back voltage opposing the voltage of the source driving the fault current. As shown in FIG. 3(*a*), the arcs 64 persist as long as current is in the ribbon 44, and burn back or melt the ribbon 44 to lengthen the gaps 62 and elongate the arcs 64 as the pair of sites or fronts 66 defining each gap 62 recede from each other. Upon formation of the arcs 64, the total arc voltage of the fuse 10 jumps from a small value near zero to a substantial value which is, nevertheless, somewhat less than the voltage of the source driving the fault current. This is due to the establishment of the arcs 62 and to the action thereon of the fulgurite-forming medium (not shown in FIG. 3) surrounding the ribbon 44. As the arcs 64 burn back the ribbon 44 within the region 54, the arc voltage increases due to the presence of "new" or "fresh" medium adjacent the ends of the arcs 64 and to the elongation of the area 64. Such new medium is "introduced" to the arcs 64 as the sites 66 between which each arc 64 forms recede from each other, causing the arcs 64 to interact with medium formerly adjacent only the ribbon 44.

As the arcs 64 elongate and as the ribbon 44 is burned back, new medium is introduced thereto, and the arc voltage or back voltage of the fuse 10 continues to increase. The increasing arc voltage causes the current to turn down and gradually approach zero. The continuing burn-back of the ribbon 44 effects a continuing increase of the arc voltage. Through the time depicted in FIG. 3(*b*), each area of the ribbon 44 formerly containing a group 46 of two holes 40 has two arcs 64 therein. Each arc 64 is formed in a gap 62 defined by a pair of sites 66. As each arc 64 burns back the ribbon 44 and the sites 66 defining it recede from each other, its arc voltage elevates at a rate determined by the rate of burn-back. Thus, each group 46 is responsible for increasing the arc voltage at a rate of two times the rate achieved by each individual arc 64. Each group 46 includes four sites 66 between pairs of which the arcs 64 form.

Referring to FIG. 3(*b*), the arcs 64 in each group and within the regions 54 ultimately nearly simultaneously "merge" into a single arc 68 as the ribbon 44 formerly present between the holes 40 in the groups 46 is consumed by burn-back of the ribbon 44. As noted above, the distance between each end hole 40 of each group 46 and the "end" 56 of the facing, adjacent region 52 is equal to one-half the distance between adjacent holes 40 in each group 46. As a consequence, the farthest right-hand site 66 of each group 46 moves rightwardly toward the "end" 56 of the adjacent region 52 at about the same rate as the farthest left-hand site 66 of each group 46 moves leftwardly toward the "end" 56 of the adjacent region 52. Further, the rate of movement of these two sites 66 is about the same as that at which each of the two middle sites 66 moves toward each other. Thus, as the arcs 64 in each group 46 merge, arcing sites 66 are established at the "ends" 56 of the wider first regions 52 along which further burn-back of the ribbon 44 occurs.

Assuming merger to have occurred, and going from FIG. 3(*b*) to FIG. 3(*c*), each merged arc 68 continues to burn the ribbon 44 back at its two remaining sites 66 which now extend across the wider regions 52. The number of sites 66 (two) remaining in FIG. 3(*c*) for each arc 68, which now occupies the former location of one of the groups 46 and one of the narrower regions 54 is one-half of the number of original sites 66 (four) in FIGS. 3(*a*) and 3(*b*). If each group 46 contains three, four or N holes 40, the fraction is, respectively, $\frac{1}{3}$, $\frac{1}{4}$ or 1/N. Ignoring for now the effect of the wider regions 52 relative to the narrower regions 54, in FIG. 3(*c*), as the merged arcs 58 continues to burn the ribbon 44 back, the arc voltage increases, albeit at a decreased rae of about $\frac{1}{2}$ (or, more generally, 1/N) the original rate, as set forth in the '712 application. This burn-back rate decrease is primarily due to the fact that new sand is introduced to the arcs 68 and to the arcs 68 being elongated as only two sites 66 (instead of four) recede from each other. The portions of the merged arcs 68 remote from the sites 66 are in the vicinity of "old" medium which does not possess constricting and cooling properties to the same degree as fresh medium.

The fact that the regions 52 (now containing the sites 66 on which the merged arcs 68 terminate) are wider than the regions 54 in which the original arcs 64 were located further slows the rate of burn-back of the ribbon 44 by the arcs 68 and, consequently, further slows the rate of increase of the back voltage of the fuse 10, relative to the values both would have if the constant width ribbon of the '712 application were used. The dimensions and number of the regions 52 and 54 and of the holes 40, and the spacings between the holes 40 and the groups 46 are all selected so that the increase of back voltage due to the arcs 66 is sufficient to first limit and then substantially turn down the fault current. Slowing the burn-back rate (and the back voltage increase rate) of the ribbon 44 after the arcs merge does sacrifice extremely efficient interruption of the fuse 10, but ensures that the back voltage does not exceed a maximum value (e.g., the spark-over value of phase-to-ground arrestors) for a phase-to-ground fault interruption. It should be noted that although the rate of arc voltage increase is slowed, cooling of the arcs 68 is not compromised since "new" sand is introduced to the elongating arcs 68 at a relatively high rate because of the wider arcing sites 66 offered by the wider regions 52.

Thus, during the time the arcs 64 are established, the total arc voltage or back voltage of the fuse 10 increases at a rate determined by the rate of burn-back of the ribbon 44 effected by each arc 64 multiplied by the number of holes 40 in each group 46 multiplied by the number of groups 46. The total arc voltage or back voltage during this period is determined by the amount of burn-back effected by each arc 64 multiplied by both the number of holes 40 in each group 46 multiplied by the number of groups 46. After the merged arcs 68 form, the rate of increase of the total arc voltage or back voltage of the fuse 10 is decreased by a factor $1/(N+\Delta)$, that is, is decreased by a factor related to merger of the arcs 64 into the arcs 68 (the N portion of the factor) and by the effect of the wider regions 52 (the $\Delta$ portion of the factor). The total arc voltage or back voltage during the establishment of the merged arcs 68 is determined by the total amount of burn-back effected by the arcs 66 prior to formation of the merged arcs 68, plus the amount of reduced rate burn-back of the wider regions 52 effected by each merged arc 68.

Assuming the fault current to be driven by a 15 kv source (a phase-to-phase fault), the arc voltage of the fuse 10 exceeds the source voltage shortly after the initial jump in arc voltage caused by establishment of the arcs 64. By selecting a sufficiently long ribbon 44, a sufficiently high arc voltage or back voltage will be generated to assure interruption of the higher voltage fault current. Ultimately, at a current zero the arcs 68 are extinguished and the fault current is interrupted. The fact that the arc voltage or back voltage of the fuse 10 may greatly exceed the source voltage during interruption of the phase-to-phase fault is of no great concern. As postulated, each fuse 10 by itself must be capable of interrupting phase-to-phase faults because its operation is initiated by the opening of the shunt switch 24, not by the $I^2t$ effect of the fault current. Moreover, phase-to-ground arrestors do not directly "see" the arc voltage or back voltage during phase-to-phase faults and as a result will not spark over as a result thereof.

At lower voltage phase-to-ground faults, if the arc voltage or back voltage of the fuse 10 so increases as to exceed the sparkover voltage of the arrestors, they will undesirably operate. The merging of the arcs 64 into the arc 68 and the effect of the wider regions 52 co-act to prevent this occurrence. Specifically, the significant degree of fault current turndown for a phase-to-ground fault achieved by the burn-back of the arcs 64 may be sufficient to interrupt the fault current just before or as the merged arcs 68 are established. The number of holes 40, their distance 48 apart in the groups 46 and the number of groups 46 are selected to achieve or closely approach this result without exceeding the sparkover voltage of the arrestors. If the lower voltage fault current is not interrupted as the merged arcs 68 form, the significant initial current turndown and the subsequent more slowly increasing arc voltage or back voltage (albeit at the decreased, $1/(N+\Delta)$, rate) shortly effect interruption. The decreased rate of increase in the arc voltage or back voltage is selected so that the sparkover voltage of the arrestors is not exceeded.

In effect, then, the location of the holes 40 in the groups 46 and the presence of the wider first regions 52 permit burn-back of the ribbon 44, elongation of the arcs 64 and 68, and elevation of the arc or back voltage to occur at two different rates. A first or higher rate obtains when the arcs 64 are established. A second or slower rate ($1/(N+\Delta)$ times the first rate) obtains when the merged arcs 68 are established. Stated differently, once the merged arcs 68 are established, the rate of introduction of the ribbon 44 to burn-back and the rate of introduction of fresh or new medium to the arcs 68 decreases. The amount of decrease of these rates can be adjusted by appropriate selection of the number of holes 40 in each group 46. Similarly, the first rate may be adjusted by appropriate selection of the number of holes 40 in each group 46, the number of groups 46, and the distance 48; just as the second rate may be adjusted by appropriate selection of the number of groups 46, the distance 50, and the width of the regions 52. The total are voltage or back voltage which can be generated by the fuse 10 depends on appropriate selection of all of these items and on the length of the ribbon 44. Various permutations and combinations of all pertinent items permit the selection of a ribbon 44 for a fuse 10 which can efficiently interrupt fault currents at two different voltages without exceeding a selected arc voltage or back voltage value.

FIG. 4 depicts an alternative embodiment of the ribbon 44 which may be used as the fusible element 12 in the fuse 10 of FIG. 1. As can be seen from FIG. 4, the alternative ribbon 44 has a configuration something like two of the ribbons 44 of FIG. 2 placed side-by-side, the outside edges of both of the ribbons being preferably, though not necessarily, straight rather than undulating. The ribbon 44 of FIG. 4 has straight outside edges centered between which is the central major axis 42. The ribbon 44 includes a longitudinally aligned series of spaced rectangular slits or cutouts 80 along its length. These slits or cutouts 80 are preferably centered on the axis 42 and have their long dimensions parallel thereto. The portions of the ribbon 44 transverse of the axis 42 which are laterally defined between the sides of the slits or cutouts 60 and the edges of the ribbon 44 and are longitudinally defined between the "ends" 56 (which coincide with the longitudinal ends of the slits 80) are the second regions 54. In these regions 54 are formed the groups 46 of holes 40, each group 46 containing two or more holes 40. The portions of the ribbon 44 between the groups 46 (and the "ends" 56) are the regions 52. The regions 52 are laterally integral or continuous. Whether the ribbon 44 is considered as a single ribbon or more like two side-by-side ribbons of the type depicted in FIG. 2, the width of the regions 52 is greater than the width of the regions 54 in the manner, and to the same end, as previously described. The ribbon 44 of FIG. 4 may assume the character of three or more of the side-by-side ribbons 44 of FIG. 2, in which event two or more laterally adjacent, longitudinally aligned series of slits 80 will be present.

In an exemplary ribbon 44 of the type depicted in FIG. 4 for use in a fuse 10 having a 600 ampere continuous current rating, the distances 48 and 50 are the same as described with reference to FIG. 2. The slits or cutouts 60 each have a width of 0.060 inch and a length of 0.940 inch. The holes 40, which are approximately 0.147 inch in diameter, are preferably located symmetrically with respect to the sides of the slits or cutouts 60 and the straight edge of the ribbon 44 having their centers approximately 0.110 inch away from each. In FIG. 4, the total width of the ribbon measured at one of the wider first regions 52 is approximately 0.440 inch, and each laterally adjacent narrower second region 54 is about 0.220 inch wide. The ribbon 44 of FIG. 4 is usable in any fuse 10, wherein formerly two or more separate helically wound fusible elements 12 were required. Further, the ribbon 44 depicted in FIG. 4 may find convenient use in the type of fuse 10 herein depicted wherein the fusible element 12 normally carries no current and is suddenly forced to carry current upon the opening of the switch 24.

The operation of the fuse 10, including the fusible element 12, which comprises a ribbon 44 as shown in FIG. 4, is similar to that described above with reference to FIGS. 2 and 3. The most efficient operation of the ribbon 44 is achieved if the arcs 64, which initially form in laterally adjacent side-by-side regions 54, do not interact or merge with each other until the outside site 66 of each group 46 reaches an "end" 56. This may be achieved as shown in FIG. 5 by deforming the second regions 54 perpendicular to the plane of the ribbon 44. Specifically, one region 54 of each laterally adjacent pair of regions 54 is deformed upwardly, while the other region 54 is deformed downwardly, as shown in FIG. 5. This deformation both positions laterally adjacent regions 54 of the ribbon 44 away from each other so that the arcs 64 therein do not interact with each other, and ensures that the arcs 64 forming in each region 54 are exposed to "new" sand uncontaminated by the arcs 64 in the laterally adjacent region 54, thereby efficiently cooling and constricting each arc 64.

FIGS. 6(*a*)–6(*c*) depict a sequence of operation of the ribbon 44 shown in FIG. 4 similar to that depicted in FIGS. 3(*a*)–3(*c*) for the ribbon 44 shown in FIG. 2.

In addition to the operational advantages achieved by the ribbons 44 depicted in FIGS. 2 and 4, the ribbon 44 in FIG. 4 offers additional constructional advantages when used in a fuse 10 which would normally require two fusible elements 12. Specifically, in addition to the electrical operation of the ribbon 44 of FIG. 4 being similar to the electrical operation of the ribbon 44 of FIG. 2 and viewing the ribbon 44 in FIG. 4 as, in effect, two side-by-side, joined together ribbons, it is noted that, because the regions 44 of each "ribbon" are integral, the two side-by-side "ribbons" are in effect mechanically joined together to ensure that each is wound about the support 14 in FIG. 1 and is maintained a constant distance away from its adjacent "ribbon" over the entire length of such winding. A somewhat similar, but not as effective constructional feature is depicted in U.S. Pat. No. 4,210,892. In that patent, in contrast to the present invention, mechanical "bridges" adjoining adjacent ribbons are not as robust as are the regions 52 of the ribbon 44 shown in FIG. 4. Additionally, it should be noted that the fusible elements of the '892 patent do not contain holes associated together in groups in which the distance between adjacent holes within a group is substantially less than the distance between adjacent groups. Accordingly, burn-back rate is not slowed down by arc merger; arc merger does not occur therein. Further, these "bridges" do not play a role in decreasing the burn-back rate, as do the regions 52.

Various changes may be made in the above-described embodiments of the present invention without departing from the spirit and scope thereof. Such changes as are within the scope of the claims that follow are intended to be covered thereby.

We claim:

1. A fusible element for a high-voltage, current-limiting fuse, comprising:

an elongated, thin, conductive ribbon of substantially uniform thickness, the ribbon including first and second regions of two different widths measured transversely of the ribbon, the regions alternating along the ribbon, the width of the first regions being greater than the width of the longitudinally adjacent second regions, there being at least two second regions, and a plurality of groups of holes or notches formed through or in the ribbon, each group being within a respective second region and extending along the ribbon, adjacent holes or notches of each group being separated therewithin by a first distance, measured along the ribbon, which is substantially less than a second distance between adjacent groups, measured along the ribbon, so that both higher and lower voltage fault currents are effectively interrupted, and so that the arc voltage developed by the fuse during the occurrence of the lower voltage fault currents does not exceed a predetermined value.

2. A fusible element as in claim 1, wherein the ribbon as a central major axis, and the regions and the holes or notches are laterally symmetrically related to the axis.

3. A fusible element as in claim 1, wherein the regions are defined between the edges of the ribbon which undulate along the length thereof.

4. A fusible element as in claim 3, wherein the undulations have a square-wave configuration.

5. A fusible element as in claim 4, wherein the ribbon has a central major axis, and the regions, the undulations and the holes or notches are laterally symmetrically related to the axis.

6. A fusible element as in claim 1, wherein the length of the first regions is less than the length of the second regions, each length being measured along the ribbon.

7. A fusible element as in claim 1, wherein the distance between the lateral end of each first region and the longitudinally adjacent hole is substantially equal to one-half the distance between longitudinally adjacent holes in a group.

8. A fusible element as in claim 7, wherein the length of the first regions between their lateral ends is less than the length of the second regions between their lateral ends.

9. A fusible element which comprises at least two of the fusible elements of claim 1 unitarily formed side-by-side so that the laterally adjacent first regions of each are integral or continuous and are aligned laterally of the ribbon, so that the laterally adjacent second regions of each are laterally separated and are aligned laterally of the ribbon, and so that the each group is laterally aligned with its laterally adjacent groups.

10. A fusible element as in claim 9, wherein laterally adjacent second regions are alternately positioned above and below the plane of the ribbon and of the longitudinally adjacent first regions.

11. A fusible element as in claim 9, wherein the separation between laterally adjacent second regions has the configuration of an elongated slit through or in the ribbon, the long dimension of the slits extending along the ribbon and along the second regions, the width of each slit being substantially less than the width of the second regions.

12. A fusible element as in claim 11, wherein the holes or notches of each group are centered between the long dimension of a laterally adjacent slit and either the laterally adjacent edge of the ribbon or the laterally adjacent long dimension of a laterally adjacent slit.

13. A fusible element as in claim 9, wherein the length of the first regions is less than the length of the second regions, each length being measured along the ribbon.

14. A fusible element as in claim 9, wherein the distance between the lateral end of each first region and the longitudinally adjacent holes of each longitudinally adjacent second regions is substantially equal to one-half the distance between longitudinally adjacent holes in a group.

15. A fusible element as in claim 14, wherein the length of the first regions between their lateral ends is less than the length of the second regions between their lateral ends.

16. A fusible element for a high-voltage, current-limiting fuse, comprising:

an elongated, thin, conductive ribbon of substantially uniform thickness and, between its edges, a substantially uniform width, at least one series of at least two elongated slits formed through or in the ribbon, each slit having the same size and a long dimension substantially greater than the short dimension thereof, the slits of each series being aligned along the ribbon, adjacent slits of adjacent series being aligned transversely of the ribbon, each slit having its long dimension extending along the ribbon, the slits of each series having similar transverse locations relative to the edges of the ribbon, the slits effectively dividing the ribbon into a plurality of longitudinally alternating first and second regions, the first regions being those integral and continuous portions of the ribbon between its edges which lie between the short dimension of longitudinally adjacent slits of each series, the second regions being those portions of the ribbon lateral of the slits and either between one edge of the ribbon and the long dimension of a slit or between the long dimension of laterally adjacent slits of laterally adjacent series, the first regions being wider than the second regions, each of the latter of which has the same width measured transversely of the ribbon, the short dimension of each slit being substantially less than the width of the second regions, and a plurality of groups of holes or notches formed through or in the ribbon, each group being within a respective second region and extending in line along the ribbon, longitudinally adjacent holes or notches of each group being separated therewithin by a first distance, measured along the ribbon, which is substantially less than a second distance between longitudinally adjacent groups measured along the ribbon, so that both higher and lower voltage fault currents are effectively interrupted, and so that the arc voltage developed by the fuse during the occurrence of the lower voltage fault currents does not exceed a predetermined value.

17. A fusible element for a high-voltage, current-limiting fuse, comprising:

an elongated, thin, conductive ribbon of substantially uniform thickness, the ribbon including first and second regions of two different widths measured transversely of the ribbon, the regions alternating along the ribbon, the width $W_1$ of the first regions being greater than the width $W_2$ of the longitudinally adjacent second regions, $(W_1/W_2)$ being at least about 1.1, there being at least two second regions, and a plurality of groups of N holes or notches formed through or in the ribbon, each group being within a respective second region and extending along the ribbon, adjacent holes or notches of each group being separated therewithin by a first distance X, measured along the ribbon, which is substantially less than a second distance Y between adjacent groups, measured along the ribbon, N being 2 or more and (Y/X) being at least about 2.

18. A fusible element as in claim 17, wherein each first region has a length $L_1$ which is less than the length $L_2$ of each second region, each length being measured along the ribbon and $(L_1/L_2)$ being at least about 2.

* * * * *